US009347253B2

(12) United States Patent
Shibayama et al.

(10) Patent No.: US 9,347,253 B2
(45) Date of Patent: May 24, 2016

(54) VEHICLE DOOR OPENING/CLOSING DEVICE

(71) Applicant: AISIN SEIKI KABUSHIKI KAISHA, Kariya-shi (JP)

(72) Inventors: Satoshi Shibayama, Nagoya (JP); Takeshi Nishikibe, Tokai (JP); Toshio Machida, Toyota (JP)

(73) Assignee: AISIN SEIKI KABUSHIKI KAISHA, Kariya-Shi, Aichi-Ken (JP)

( * ) Notice: Subject to any disclaimer, the term of this patent is extended or adjusted under 35 U.S.C. 154(b) by 0 days.

(21) Appl. No.: 14/380,770

(22) PCT Filed: Mar. 18, 2013

(86) PCT No.: PCT/JP2013/057652
§ 371 (c)(1),
(2) Date: Aug. 25, 2014

(87) PCT Pub. No.: WO2013/141203
PCT Pub. Date: Sep. 26, 2013

(65) Prior Publication Data

US 2015/0020450 A1 Jan. 22, 2015

(30) Foreign Application Priority Data

Mar. 22, 2012 (JP) ..... 2012-065519

(51) Int. Cl.
*E05F 15/603* (2015.01)
*E05F 15/18* (2006.01)
(Continued)

(52) U.S. Cl.
CPC ..... *E05F 15/18* (2013.01); *E05B 81/76* (2013.01); *E05B 83/40* (2013.01); *E05B 85/10* (2013.01);
(Continued)

(58) Field of Classification Search
IPC ..... E05F 15/18,7/00, 3/224, 15/14, 15/646
See application file for complete search history.

(56) References Cited

U.S. PATENT DOCUMENTS 2,552,356 A * 5/1951 Weigele ..... 49/210
6,247,343 B1 * 6/2001 Weiss et al. ..... 70/277
(Continued)

FOREIGN PATENT DOCUMENTS

CN 1524732 A 9/2004
CN 1253642 C 4/2006
(Continued)

OTHER PUBLICATIONS

Translation of International Preliminary Report on Patentability (Form PCT/IB/373) and the Written Opinion of the International Searching Authority (PCT/ISA/237) issued on Sep. 23, 2014, by the International Bureau of WIPO in corresponding International No. PCT/JP2013/057652. (4 pages).
(Continued)

*Primary Examiner* — Gregory Strimbu
(74) *Attorney, Agent, or Firm* — Buchanan Ingersoll & Rooney P.C.

(57) ABSTRACT

A vehicle door opening/closing device, which enhances the operation feeling during opening and closing of a vehicle door, includes: an outside door handle provided to a power sliding door for opening and closing a door opening, the outside door handle being supported to move between an initial position and a maximum movement position relative to the power sliding door, and being operated to open and close the power sliding door; a spring unit urging the outside door handle to move from the maximum movement position to the initial position; an opening/closing operation detection unit for detecting movement of the outside door handle from the maximum movement position to the initial position; a door drive mechanism for driving the opening and closing of the power sliding door; and a control unit for actuating the door drive mechanism on the basis of a detection signal outputted from the opening/closing operation detection unit.

5 Claims, 5 Drawing Sheets

(51) Int. Cl.

| | |
|---|---|
| ***E05B 81/76*** | (2014.01) |
| ***E05B 83/40*** | (2014.01) |
| ***E05B 85/10*** | (2014.01) |
| ***E05F 3/22*** | (2006.01) |
| ***E05F 7/00*** | (2006.01) |
| ***E05F 15/14*** | (2006.01) |
| ***E05F 15/646*** | (2015.01) |
| *E05D 15/10* | (2006.01) |
| *E05F 15/75* | (2015.01) |
| *E05B 85/16* | (2014.01) |
| *E05C 17/60* | (2006.01) |

(52) U.S. Cl.

CPC . *E05F 3/224* (2013.01); *E05F 7/00* (2013.01); *E05F 15/14* (2013.01); *E05F 15/646* (2015.01); *E05B 85/16* (2013.01); *E05C 17/60* (2013.01); *E05D 15/10* (2013.01); *E05F 15/75* (2015.01); *E05Y 2201/22* (2013.01); *E05Y 2201/232* (2013.01); *E05Y 2201/68* (2013.01); *E05Y 2900/531* (2013.01)

(56) References Cited

U.S. PATENT DOCUMENTS

| | | | | |
|---|---|---|---|---|
| 7,057,307 | B2 | 6/2006 | Yokomori | |
| 8,002,328 | B2 * | 8/2011 | McKee et al. | 296/146.4 |
| 2001/0005082 | A1 * | 6/2001 | Suparschi | 292/347 |
| 2002/0056232 | A1 | 5/2002 | Choi | |
| 2002/0089194 | A1 | 7/2002 | Nomura et al. | |
| 2003/0223175 | A1 | 12/2003 | Yokomori | |
| 2004/0129040 | A1 * | 7/2004 | Mathofer et al. | 70/208 |
| 2004/0223336 | A1 | 11/2004 | Murakami et al. | |
| 2005/0047162 | A1 | 3/2005 | Baek | |
| 2007/0130837 | A1 | 6/2007 | Kusunoki | |
| 2009/0033256 | A1 | 2/2009 | Kamiya et al. | |
| 2011/0144868 | A1 * | 6/2011 | Tezak et al. | 701/49 |
| 2011/0302842 | A1 * | 12/2011 | Sonnek et al. | 49/349 |

FOREIGN PATENT DOCUMENTS

| | | | |
|---|---|---|---|
| CN | 100411914 | C | 8/2008 |
| DE | 19924028 | A1 | 11/2000 |
| JP | 2825567 | B2 | 11/1998 |
| JP | 2003-155870 | A | 5/2003 |
| JP | 2007-085032 | A | 4/2007 |
| JP | 2007-182748 | A | 7/2007 |
| JP | 2010-270490 | A | 12/2010 |

OTHER PUBLICATIONS

International Search Report (PCT/ISA/210) mailed on Jun. 25, 2013, by the Japanese Patent Office as the International Searching Authority for International Application No. PCT/JP2013/057652.

Official Action issued by the State Intellectual Property Office of the People's Republic of China on Aug. 6, 2015 in Chinese Application No. 201380014683.X and English language translation of Official Action (17 PGS).

* cited by examiner

VEHICLE DOOR OPENING/CLOSING DEVICE

FIELD OF THE INVENTION

The present invention relates to a vehicle door opening-closing device that controls the opening or closing of a vehicle door based on an opening or closing operation of a door handle.

BACKGROUND OF THE INVENTION

In the prior art, a variety of vehicle door opening-closing device have been proposed. For example, Japanese Laid-Open Patent Publication No. 2007-182748 describes a vehicle door opening-closing device that is applied to a vehicle door that slides to open and close a door opening formed in a vehicle body.

The vehicle door opening-closing device includes a door handle that is pivotally supported by a vehicle door, an opening-closing operation detector that detects an operation of the opening or closing operation of the door handle, a door drive mechanism that drives and opens or closes the vehicle door, and a controller that actuates the door drive mechanism based on a detection signal received from the opening-closing operation detector. For example, when a user pushes the door handle toward an inner side of the vehicle when the vehicle door is fully closed, the opening-closing operation detector detects a door handle opening operation and outputs a detection signal to the controller. When receiving the detection signal, the controller drives the door drive mechanism to move the vehicle door in an opening direction. Thus, the vehicle door automatically moves in the opening direction from the fully closed state when the user pushes the door handle toward the inner side of the vehicle.

SUMMARY OF THE INVENTION

Problems that are to be Solved by the Invention

In the vehicle door opening-closing device described in Japanese Laid-Open Patent Publication No. 2007-182748, however, the opening-closing operation detector detects the door handle opening operation when the user pushes the door handle. Then, the opening-closing operation detector outputs the detection signal to the controller. That is, when the user pushes the door handle, the vehicle door automatically starts moving in the opening direction from the fully closed state. Under this situation, the user may continue to hold the door handle. This may pull the user, who is holding the door handle, in the opening direction as the vehicle door moves in the opening direction. Thus, the opening operation of the vehicle door may produce an operational feel that is annoying to the user. The same problem occurs during the closing operation of the vehicle door.

It is an object of the present invention to provide a vehicle door opening-closing device that performs opening and closing operations of a vehicle door and improves the operational feel of the vehicle door during an opening or closing operation.

Means for Solving the Problem

To achieve the above object, one aspect of the present invention includes a door handle that is supported by a vehicle door arranged on a vehicle body, wherein the door handle is movable from an initial position to a movement position and operated to open or close the vehicle door, an urging member that urges and moves the door handle from the movement position to the initial position, an opening-closing operation detector that detects movement of the door handle from the movement position to the initial position, a door drive mechanism configured to drive and open or close the vehicle door, and a controller that actuates the door drive mechanism based on a detection signal that is output from the opening-closing operation detector.

Another aspect of the present invention includes an opening-closing operation detector configured to detect movement of a door handle from a movement position to an initial position. The door handle is arranged on a vehicle door and supported by the vehicle door so that the door handle is movable between the initial position and the movement position and operated to open or close the vehicle door. The door handle is urged by an urging member to move from the movement position to the initial position. The aspect of the present invention further includes a door drive mechanism configured to drive and open or close the vehicle door and a controller that actuates the door drive mechanism based on a detection signal that is output from the opening-closing operation detector.

In the above structure, when the door handle is operated to open or close the vehicle door, the opening-closing operation detector detects movement of the door handle from the movement position to the initial position, and the vehicle door is driven to open or close. Here, the door handle is urged by the urging member to move from the movement position to the initial position. This allows the door handle to move from the movement position to the initial position without being held by the user.

Accordingly, the vehicle door may be driven to open or close without the door handle being held by the user. This improves the operational feel of the vehicle door during the opening or closing operation when the vehicle door is driven to open or close.

Effects of the Invention

As described above in detail, the operational feel during an opening or closing operation of the vehicle door may be improved when the vehicle door is driven to open or close.

DETAILED DESCRIPTION OF THE INVENTION

One embodiment of the present invention will now be described in detail with reference to FIGS. 1 to 3. In the embodiment, one example of a vehicle door opening-closing device that is applied to a sliding side door including a power assist mechanism (power sliding door) will be described.

Figure 1:
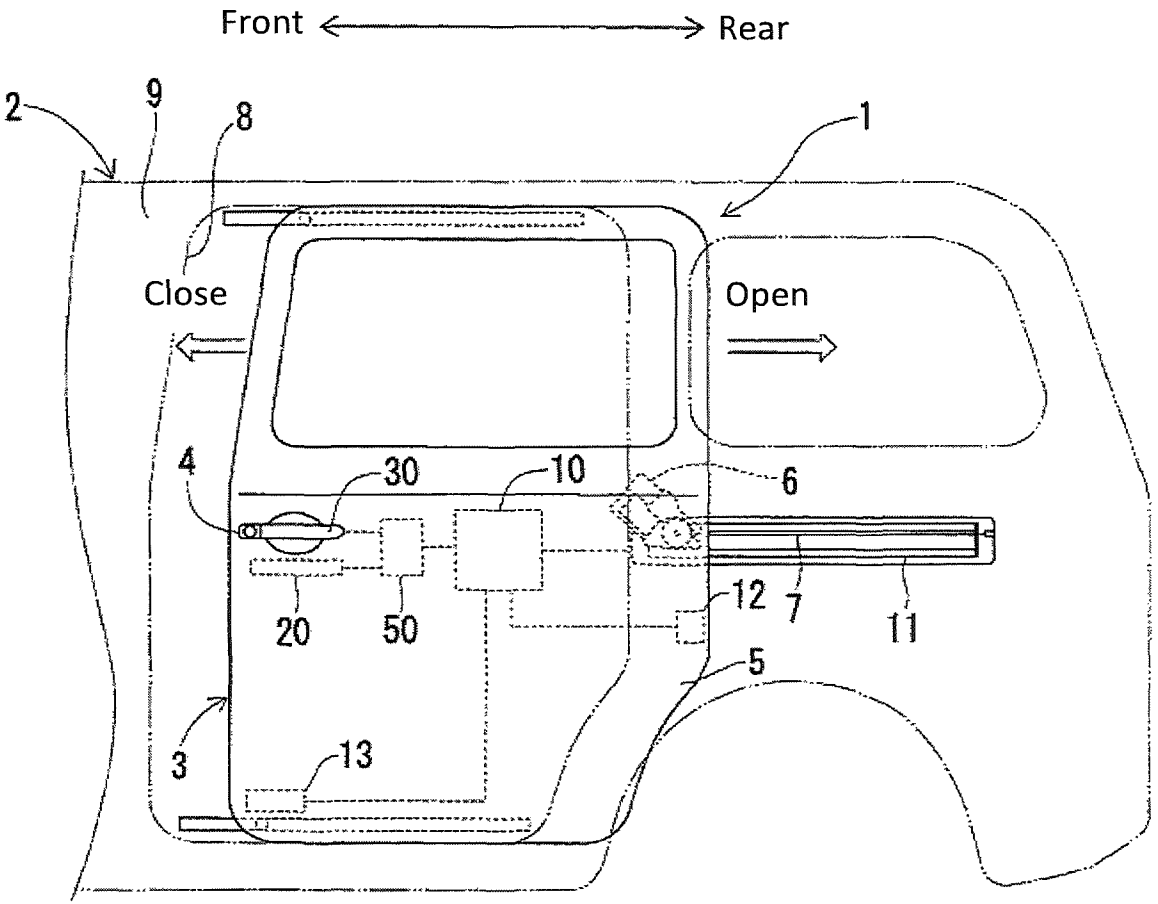
FIG. 1 is a side view showing a portion of a vehicle that includes a vehicle door opening-closing device according to one embodiment of the present invention.

As shown in FIG. 1, a vehicle door opening-closing device 1 is installed in a power sliding door 3 (vehicle door). The vehicle door opening-closing device 1 includes an actuator 6 located in the power sliding door 3, a transmission mechanism such as a door opening-closing wire 7 located between the power sliding door 3 and a vehicle 2, and a controller 10. The actuator 6 and the door opening-closing wire 7 forms a door drive mechanism.

The power sliding door 3 is installed in such a manner that the power sliding door 3 is slidable in a front-rear direction of the vehicle 2 along a slide rail 11 to open and close a door opening 8 that is formed in a vehicle body 9 of the vehicle 2. When the power sliding door 3 slides toward the rear, the door opening 8 opens. When the power sliding door 3 slides toward the front, the door opening 8 closes.

The actuator 6, which includes an electric motor, is electrically connected to the controller 10 and driven based on a control signal from the controller 10. Driving power transmitted from the actuator 6 through the door opening-closing wire 7 slides the power sliding door 3 in the front-rear direction. The controller 10 includes an electronic control unit (ECU) that includes a CPU, a ROM, a RAM, and the like. The controller 10 performs a calculation in advance in accordance with a control program, which is stored in the ROM or the like.

A door panel 5 of the power sliding door 3 includes an outside door handle 4 (door handle) that is operated to open or close the power sliding door 3. The actuator 6 is driven based on an opening operation or a closing operation performed on the outside door handle 4, and the power sliding door 3 accordingly slides in the opening direction or in the closing direction. The actuator 6 is driven based on the opening-closing operation of the outside door handle 4 when the power sliding door 3 is fully closing or fully opening the door opening 8 or when the power sliding door 3 is stopped at an intermediate position (for example, the door opening 8 is half open).

A door lock device 12, which restricts an opening movement of the power sliding door 3 from the fully closed state, and a full-open stopper 13, which restricts a closing movement of the power sliding door 3 from a fully open state, are each arranged between the power sliding door 3 and the vehicle 2. Whenever the power sliding door 3 performs an opening operation from the fully closed state, the controller 10, which is located in the power sliding door 3, cancels the restriction of the door lock device 12. When the power sliding door 3 performs a closing operation from the fully open state, the controller 10 cancels the restriction of the full-open stopper 13. The door lock device 12 moves and locks the power sliding door 3 using an electric motor, and functions as a so-called easy closer.

The vehicle door opening-closing device 1 includes a position sensor (not shown in the drawings) that detects the position of the power sliding door 3. In the embodiment, the position sensor includes, for example, a hall IC. The hall IC outputs the number of rotations generated in the actuator 6. The controller 10 detects the position of the power sliding door 3 based on the number of rotations generated in the actuator 6.

Figure 2:
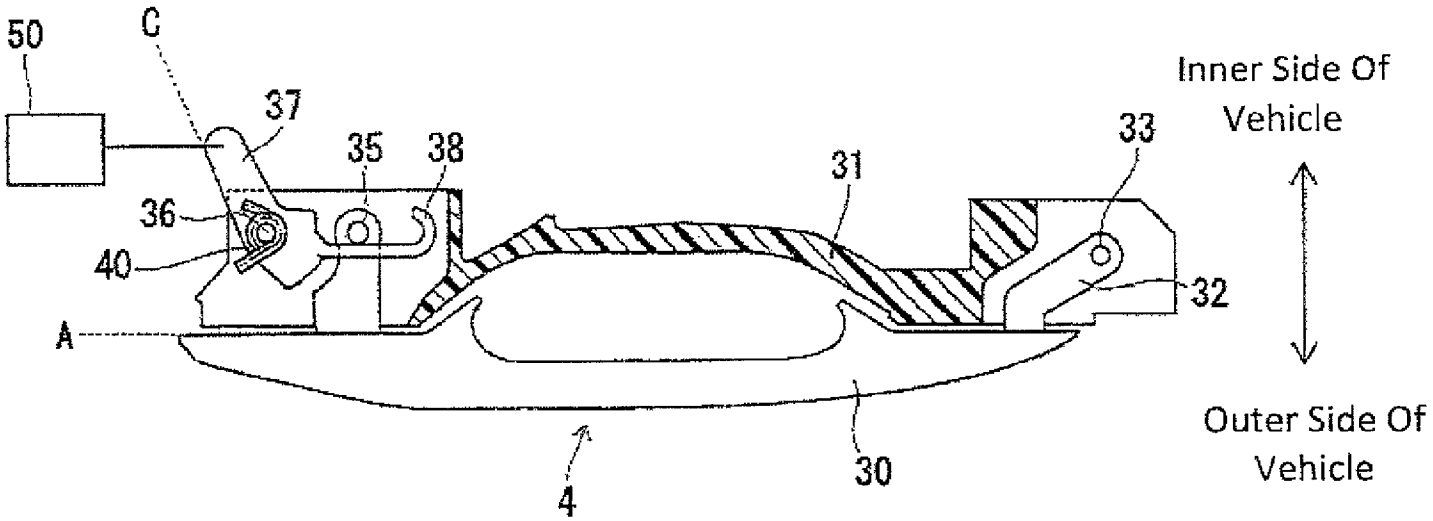
FIG. 2 is a top view showing a mode when a door handle of the embodiment is in an initial position.

As shown in FIG. 2, the outside door handle 4 includes a door grip 30, which is attached to an outer side of the door panel 5 of the power sliding door 3, and a frame member 31, which is fixed to an inner side of the door panel 5 opposing the door grip 30. The door grip 30 extends in the sliding direction of the power sliding door 3. One end (right end in FIG. 2) of the door grip 30 includes an engagement arm 32 formed integrally with the door grip 30. A distal end of the engagement arm 32 is pivotally supported by a distal end of the frame member 31 with a pivot pin 33. The other end (left end in FIG. 2) of the door grip 30 includes a protruded engagement portion 34 formed integrally with the door grip 30. A distal end of the protruded engagement portion 34 includes an engagement shaft 35.

One end of the frame member 31 includes an insertion hole, into which the engagement arm 32 is inserted. The distal end of the engagement arm 32 is pivotal about the pivot pin 33. The other end of the frame member 31 includes an insertion hole, into which the protruded engagement portion 34 is inserted, and a pivot pin 36. A pivot arm 37 is pivotally supported by the pivot pin 36. A hook portion 38, which extends from a distal end of the pivot arm 37, may abut against the engagement shaft 35. The door grip 30 is linked with the pivot arm 37 in such a manner that the movement of the door grip 30 may be transmitted to the pivot arm 37 when the engagement shaft 35 contacts the hook portion 38. A spring member 40 (urging member) is wound around the pivot pin 36. One end of the spring member 40 is fixed to the frame member 31. The other end of the spring member 40 is fixed to the pivot arm 37. As shown in FIG. 2, the pivot arm 37 is urged by the spring member 40 in the counterclockwise direction. The urging force of the spring member 40 is applied to the door grip 30 through the hook portion 38, which contacts the engagement shaft 35. This urges the door grip 30 toward an initial position A.

Figure 3:
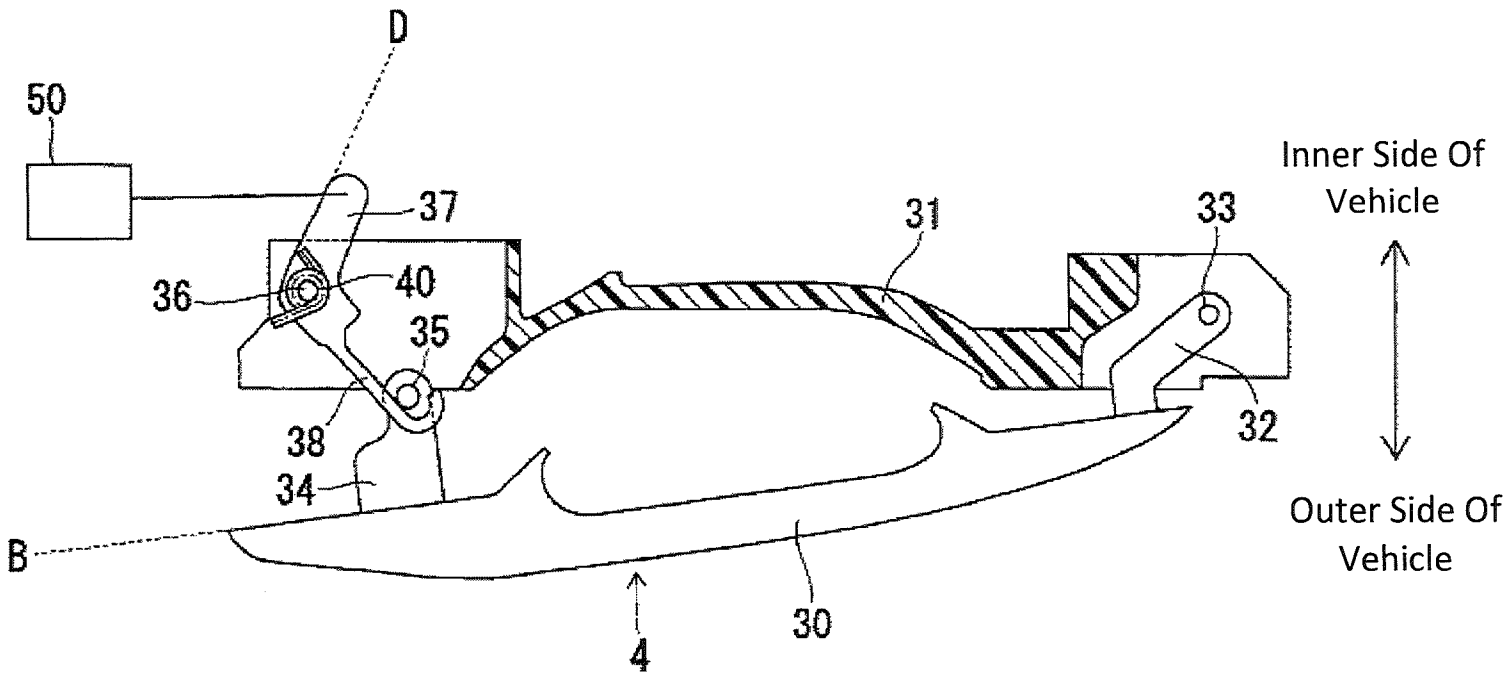
FIG. 3 is a top view showing a mode when a door handle of the embodiment is in a movement position.

As shown in FIG. 3, when a user holds the door grip 30 and pulls the door grip 30 toward the outer side of the vehicle, the door grip 30 pivotally moves toward the outer side of the vehicle about the pivot pin 33. The engagement shaft 35 of the protruded engagement portion 34 moves toward the outer side of the vehicle as the door grip 30 pivots toward the outer side of the vehicle. The engagement shaft 35 pushes the hook portion 38 of the pivot arm 37 against the urging force of the spring member 40. This pivots the pivot arm 37 in the clockwise direction. The movement of the door grip 30 toward the outer side of the vehicle is restricted when the engagement shaft 35 of the door grip 30 contacts the hook portion 38. At this point, the door grip 30 reaches a maximum movement position B (movement position). When the door grip 30, which is positioned at the maximum movement position B, is released from the held position, the pivot arm 37 is rotated in the counterclockwise direction by the urging force of the spring member 40. The hook portion 38 rotates integrally with the pivot arm 37 in the counterclockwise direction. This moves the engagement shaft 35, which is engaged with the hook portion 38, toward the inner side of the vehicle. Accordingly, the door grip 30 returns to the initial position A from the maximum movement position B as the engagement shaft 35 moves toward the inner side of the vehicle.

The present embodiment employs a structure in which the door grip 30 is urged in the counterclockwise direction when the pivot arm 37 is urged in the counterclockwise direction by the urging force of the spring member 40. However, there is no limit to such a structure, and any structure that urges the door grip 30 may be employed. For example, the door grip 30 may be connected to the door lock device 12 with a cable. In this case, the door grip 30 is urged in the counterclockwise direction with an urging member that is arranged in the door lock device 12 or on the cable.

As shown in FIG. 1, the vehicle door opening-closing device 1 includes an opening-closing operation detector 50 that detects an opening or closing operation of the outside door handle 4. In the present embodiment, the opening-closing operation detector 50 includes, for example, a limit switch or the like. The opening-closing operation detector 50 electrically detects movement of the door grip 30 when the outside door handle 4 is operated and outputs a detection result (opening-closing operation detection signal) to the electrically connected controller 10. That is, as shown in FIGS. 2 and 3, the opening-closing operation detector 50 outputs an off signal or an on signal to the controller 10 in accordance with pivot positions of the pivot arm 37 respectively corresponding to when the door grip 30 is at the initial position A or at the maximum movement position B. More specifically, the opening-closing operation detector 50 outputs, to the controller 10, an off signal when the pivot arm 37 reaches a pivot position C that corresponds to the initial position A of the door grip 30 and an on signal when the pivot arm 37 reaches a pivot position D that corresponds to the maximum movement position B of the door grip 30. The opening-closing operation detector 50 outputs the on signal when the pivot arm 37 is at the rotation position D. Instead, the opening-closing operation detector 50 may output the on signal when the pivot arm 37 is at a position located slightly toward the pivot position C from the pivot position D. In the present embodiment, the opening-closing operation detector 50 detects the initial position A and the maximum movement position B of the door grip 30 each based on the rotation position of the pivot arm 37. However, any configuration that detects the initial position A and the maximum movement position B of the door grip 30 may be employed.

A mode in which the power sliding door 3 opens and closes based on opening and closing operations of the outside door handle 4 in the present embodiment will now be described.

The controller 10 drives the power sliding door 3 based on an opening-closing operation detection signal received from the opening-closing operation detector 50. More specifically, when the opening-closing operation detector 50 detects that the outside door handle 4 has been operated in accordance with an opening-closing operation mode that is set in the controller 10 in advance, the controller 10 determines that the detected opening-closing operation has been performed on the power sliding door 3. In the present embodiment, the opening-closing operation mode is set as an aspect in which the door grip 30 moves from the initial position A to the maximum movement position B when a pulling operation is performed, and subsequently moves from the maximum movement position B to the initial position A. In other words, in the opening-closing operation mode, the controller 10 shifts from a state in which an off signal is received from the opening-closing operation detector 50 to a state in which an on signal is received and subsequently shifts to a state in which an off signal is received. Consequently, the controller 10 determines that the opening-closing operation mode has been performed on the power sliding door 3 and drives the power sliding door 3. Here, the controller 10 locks or unlocks the full-open stopper 13 or the door lock device 12. Then, the controller 10 drives the door drive mechanism to slide the power sliding door 3.

Figure 4:
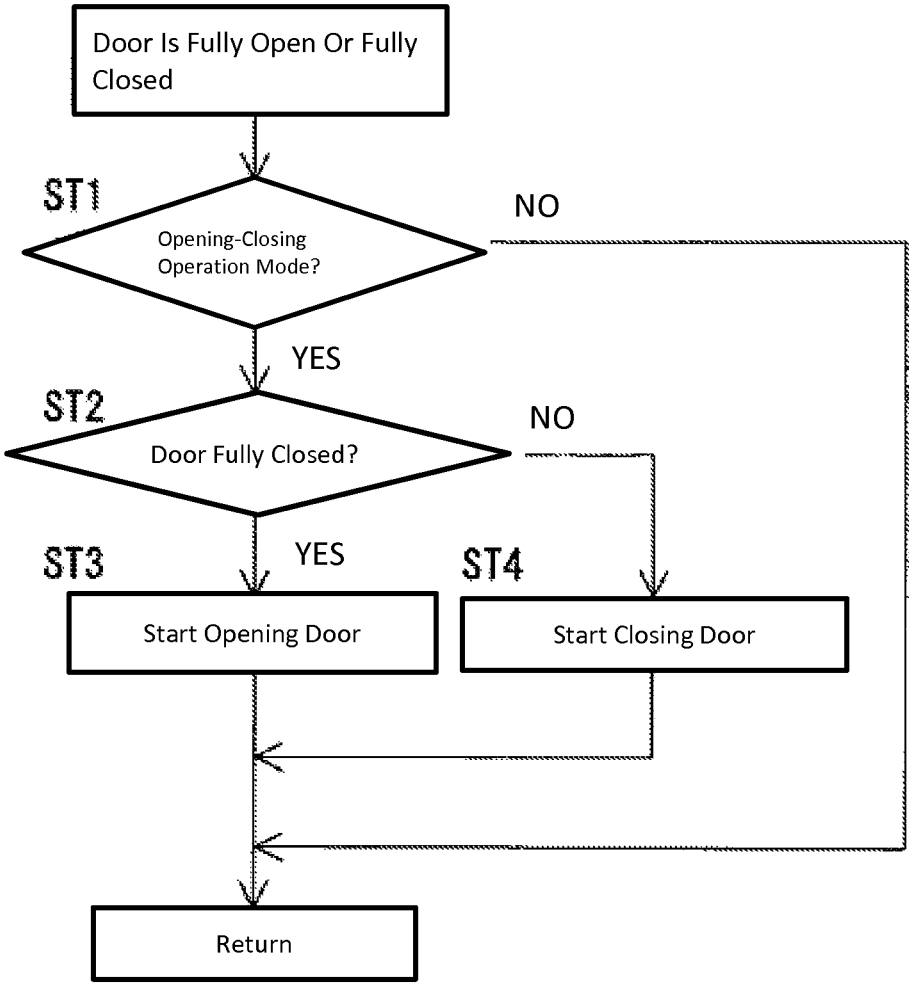
FIG. 4 is a flowchart showing an opening-closing drive control executed when the vehicle door is fully open or closed.

The mode in which the controller 10 controls the door drive mechanism when an opening or closing operation is performed on the power sliding door 3 that is in the fully closed state or in the fully open state will now be described with reference to the flowchart shown in FIG. 4. Here, the process is repeatedly performed in a predetermined cycle.

When a user performs an opening or closing operation on the power sliding door 3, in step ST1, the controller 10 determines whether or not the controller 10 receives, from the opening-closing operation detector 50, an opening-closing operation detection signal indicating that the opening-closing operation mode, which has been set in advance in the controller 10, has been performed on the power sliding door 3. That is, the controller 10 determines whether or not the above opening-closing operation mode has been performed on the outside door handle 4. The controller 10 proceeds to step ST2 if a determination result is Yes and temporarily terminates the process if the determination result is No.

In step ST2, when the controller 10 determines that the opening-closing operation mode has been performed on the outside door handle 4, a door lock (restriction of the door lock device 12 or the full-open stopper 13) is released. Then, the controller 10 determines whether the door is fully closed or fully open. If the door is fully open, the controller 10 drives the actuator 6 to fully open the power sliding door 3 and stop the power sliding door 3 when completely open (ST3). If the power sliding door 3 is not fully closed, the controller 10 determines that the power sliding door 3 is fully open. Then, the controller 10 drives the actuator 6 to fully close the power sliding door 3 and stop the power sliding door 3 when completely closed (ST4). In step ST2 of the present embodiment, the controller 10 determines whether or not the power sliding door 3 is fully closed when driving the power sliding door 3. Instead, for example, the controller 10 may determine whether or not the power sliding door 3 is fully open when driving the power sliding door 3.

Figure 5:
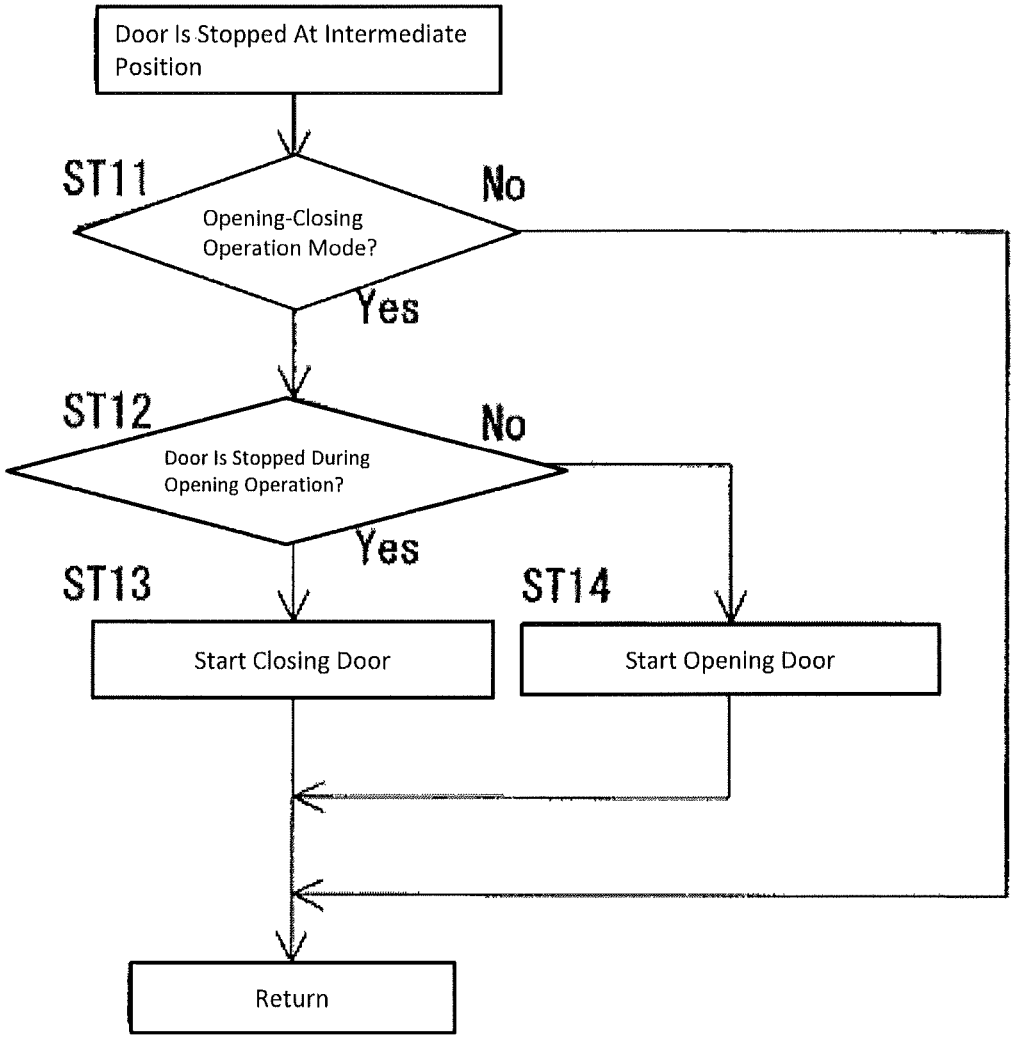
FIG. 5 is a flowchart showing the opening-closing drive control when the vehicle door is ajar.

A mode of the controller 10 for controlling the door drive mechanism when an opening or closing operation is performed on the power sliding door 3 that is stopped at an intermediate position will now be described with reference to the flowchart shown in FIG. 5. Here, the process is repeatedly performed in a predetermined cycle.

When a user performs an opening or closing operation on the power sliding door 3, in step ST11, the controller 10 determines whether or not the controller 10 receives, from the opening-closing operation detector 50, an opening-closing operation detection signal indicating that a predetermined opening-closing operation mode set in advance in the controller 10 has been performed on the power sliding door 3. That is, the controller 10 determines whether or not the above opening-closing operation mode has been performed on the outside door handle 4. The controller 10 proceeds to step ST2 if a determination result is Yes and temporarily terminates the process if the determination result is No.

When determining that the opening-closing operation mode has been performed on the outside door handle 4, in step ST12, the controller 10 determines whether the power sliding door 3 has been stopped during an opening operation and is ajar or the power sliding door has been stopped during a closing operation and is ajar. When the power sliding door 3, which is ajar, has been stopped during an opening operation, the controller 10 drives the actuator 6 to fully close the power sliding door 3 and stop the power sliding door 3 when completely closed (ST13). If the power sliding door 3, which is ajar, has not been stopped during an opening operation, the controller 10 determines that the power sliding door 3, which is ajar, has been stopped during a closing operation. In this case, the controller 10 drives the actuator 6 to fully open the power sliding door 3 and stop the power sliding door 3 when completely opened (ST14).

In ST12 of the present embodiment, the controller 10 determines whether or not the power sliding door 3 is ajar after being stopped during an opening operation to control the driving of the power sliding door 3. Instead, for example, the controller 10 may determine whether or not the power sliding door 3 is ajar after being stopped during a closing operation to control the driving of the power sliding door 3. Further, if the controller 10 determines that the opening-closing operation mode has been performed on the outside door handle 4 when the power sliding door 3 is ajar after being stopped during an opening operation, the controller 10 may drive the actuator 6 to fully open the power sliding door 3. If the controller 10 determines that the opening-closing operation mode has been performed on the outside door handle 4 when the power sliding door 3 is ajar after being stopped during a closing operation, the controller 10 may drive the actuator 6 to fully close the power sliding door 3.

Accordingly, the present embodiment has the advantages described below.

(1) The outside door handle 4 is operated to open or close the power sliding door 3. When the opening-closing operation detector 50 detects movement of the door grip 30 from the movement position to the initial position A, the power sliding door 3 is driven to open or close. Here, the door grip 30 is urged by the spring member to move from the movement position to the initial position A. This allows the door grip 30 to move from the movement position to the initial position A without being held by a user. Accordingly, the power sliding door 3 may be driven to open or close without the door grip 30 being held by the user. This improves the operational feel during an opening or closing operation of the power sliding door 3 when the power sliding door 3 is driven to open or close.

(2) When the opening-closing operation detector 50 detects movement of the door grip 30 from the maximum movement position B to the initial position A after detecting a movement of the door grip 30 from the initial position A to the maximum movement position B, the power sliding door 3 is driven to open or close. In other words, the power sliding door 3 is not driven to open or close unless the opening-closing operation detector 50 detects movement of the door grip 30 from the initial position A to the maximum movement position B. This inhibits the power sliding door 3 from being driven to open or close when an unintentional operation is performed on the door grip 30, such as when the door grip 30 is slightly moved from the initial position A and then moved to the initial position A. That is, the power sliding door 3 may not be driven to open or close when the outside door handle 4 is erroneously operated.

(3) The outside door handle 4 is operated to open or close the power sliding door 3. When the opening-closing operation detector 50 detects movement of the door grip 30 from the movement position to the initial position A, the power sliding door 3 slides in the front-rear direction of the vehicle to open or close. This prevents a user from being pulled, while holding the door grip 30, in the front-rear sliding direction of the power sliding door 3 as the power sliding door 3 opens or closes. Thus, the operational feel during an opening or closing operation of the power sliding door 3 may be improved when the power sliding door 3 is driven to open or close.

The above embodiment may be modified as described below.

In the above embodiment, the controller 10 drives the power sliding door 3 to open or close based on an opening or closing operation in accordance with an opening-closing operation mode of the outside door handle 4. Instead, the power sliding door 3 may be driven to open or close based on an opening or closing operation in accordance with an opening-closing operation mode of an inside door handle 20 shown in FIG. 1.

In the above embodiment, the door grip 30 is urged by the spring member 40 arranged in the frame member 31 that forms the outside door handle 4. Instead, the door grip 30 may be urged by a spring member arranged in a vehicle body.

In the above embodiment, one end of the door grip 30 is pivotally supported by the frame member 31, and the other end is movably hooked to the outer side of the vehicle. Instead, both ends of the door grip 30 each may be pivotally supported by the frame member 31.

In the above embodiment, the vehicle door opening-closing device 1 is applied to the power sliding door. Instead, the vehicle door opening-closing device 1 may be applied to a swing door.

In the above embodiment, the opening-closing operation mode is set in advance in the controller 10 such that the door grip 30 is moved from the initial position A to the maximum movement position B when a pulling operation is performed on the door grip 30, and subsequently the door grip 30 is moved from the maximum movement position B to the initial position A. Instead, an opening-closing operation mode may be set in advance in the controller 10 such that the door grip 30 is moved from the initial position A to an intermediate movement position located between the initial position A and the maximum movement position B, and then moved from the intermediate movement position to the initial position.

DESCRIPTION OF REFERENCE SYMBOLS

1 Vehicle Door Opening-Closing Device
3 Power Sliding Door (Vehicle Door)
4 Outside Door Handle (Door Handle)
6 Actuator
8 Door Opening
9 Vehicle Body
10 Controller
30 Door Grip
40 Spring Member (Urging Member)
50 Opening-Closing Operation Detector

The invention claimed is:

1. A vehicle door opening-closing device comprising:

a door handle that is supported by a vehicle door arranged on a vehicle body of a vehicle, wherein the door handle is movable from an initial position to a movement position and is operated to open or close the vehicle door;

an urging member that urges the door handle in a second direction from the movement position toward the initial position and moves the door handle from the movement position to the initial position after the door handle has been moved in a first direction from the initial position to the movement position and then released;

an opening-closing operation detector that detects movement of the door handle in the first direction from the initial position to the movement position and detects movement of the door handle in the second direction from the movement position to the initial position;

a door drive mechanism configured to drive the vehicle door open or closed; and a controller that actuates the door drive mechanism based on a second detection signal that is output from the opening-closing operation detector when the open-closing operation detector detects the movement of the door handle in the second direction subsequent to an output of a first direction signal that is output from the opening-closing operation detector when the opening-closing operation detector detects the movement of the door handle in the first direction.

2. The vehicle door opening-closing device according to claim 1, wherein the door handle is movable in a lateral direction of the vehicle from the initial position to a maximum movement position where movement of the door handle away from the vehicle is restricted, and the movement position is the maximum movement position.

3. The vehicle door opening-closing device according to claim 1, wherein the door handle is movable in a lateral direction of the vehicle from the initial position to a maximum movement position where movement of the door handle away from the vehicle is restricted, and the movement position is located between the initial position and the maximum movement position.

4. The vehicle door opening-closing device according to claim 1, wherein the vehicle door is a sliding door that is arranged on a side of the vehicle.

5. A vehicle door opening-closing device comprising:

an opening-closing operation detector that detects movement of a door handle in a first direction from an initial position to a movement position and that detects movement of the door handle in a second direction from the movement position to the initial position, wherein the door handle is arranged on a vehicle door, is supported by the vehicle door so that the door handle is movable between the initial position and the movement position and is operated to open or close the vehicle door, and the door handle is urged and moved by an urging member in the second direction from the movement position to the initial position after the door handle has been moved in the first direction from the initial position to the movement position and then released;

a door drive mechanism configured to drive the vehicle door open or closed; and a controller that actuates the door drive mechanism based on a second detection signal that is output from the opening-closing operation detector when the opening-closing operation detector detects the movement of the door handle in the second direction subsequent to an output of a first detection signal that is output from the opening-closing operation detector when the opening-closing operation detector detects the movement of the door handle in the first direction.

* * * * *